US009751731B1

(12) United States Patent
Masar et al.

(10) Patent No.: US 9,751,731 B1
(45) Date of Patent: Sep. 5, 2017

(54) REEL HOIST INTERLOCK SYSTEM

(71) Applicant: Georgia-Pacific Consumer Products LP, Atlanta, GA (US)

(72) Inventors: Michael F. Masar, Green Bay, WI (US); Joe S. Pierucki, Oconto, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 328 days.

(21) Appl. No.: 14/528,021

(22) Filed: Oct. 30, 2014

Related U.S. Application Data

(60) Provisional application No. 61/918,132, filed on Dec. 19, 2013.

(51) Int. Cl.

| | |
|---|---|
| ***B66C 13/16*** | (2006.01) |
| ***B66C 17/00*** | (2006.01) |
| ***B66C 15/06*** | (2006.01) |
| ***B66C 13/18*** | (2006.01) |

(52) U.S. Cl.
CPC ..... *B66C 13/18* (2013.01); *B66C 13/16* (2013.01); *B66C 15/06* (2013.01); *B66C 17/00* (2013.01)

(58) Field of Classification Search
CPC ..... B66C 13/00; B66C 13/40; B66C 13/44; B66C 15/065; B66C 1/14; B66C 1/34
USPC ..... 294/81.56, 81.51, 68.27; 73/862.392, 73/862.393
See application file for complete search history.

(56) References Cited

U.S. PATENT DOCUMENTS 2,663,865 A * 12/1953 Williams ..... B66C 13/00 200/52 R
2015/0122761 A1* 5/2015 Ford ..... B66C 13/063 212/276

FOREIGN PATENT DOCUMENTS

| | | | |
|---|---|---|---|
| CN | 2297430 | Y | 11/1998 |
| CN | 2307287 | Y | 2/1999 |
| CN | 2479489 | Y | 2/2002 |
| CN | 2892799 | Y | 4/2007 |
| CN | 201746226 | U | 2/2011 |
| CN | 202267521 | U | 6/2012 |
| CN | 202322040 | U | 7/2012 |
| CN | 202414998 | U | 9/2012 |
| DE | 4447393 | C1 | 6/1996 |
| EP | 1979259 | B1 | 9/2010 |
| JP | 05286692 | A | 11/1993 |
| KR | 20000026608 | A | 5/2000 |
| KR | 1020110129548 | A | 12/2011 |
| WO | 2007080090 | A1 | 7/2007 |

(Continued)

*Primary Examiner* — Sang Kim
*Assistant Examiner* — Juan Campos, Jr.
(74) *Attorney, Agent, or Firm* — Laura L. Bozek

(57) ABSTRACT

Embodiments of the disclosure include a reel hoist interlock system for an overhead crane having one or more sensors disposed on a hook of the overhead crane. The sensors provide a signal indicative of whether the hook is secured to an object to be lifted by the overhead crane. The reel hoist interlock system also includes transmitters in communication with the sensors. The transmitters receive and transmit the signal provided by the sensors. The reel hoist interlock system further includes a controller configured to operate the overhead crane based on an input signal received from a remote and based on the signals received from the transmitters and indicators operated by the controller based on the signals received from at least one of the transmitters and the remote.

11 Claims, 5 Drawing Sheets

(56) References Cited

FOREIGN PATENT DOCUMENTS

WO WO 2013181621 A1 * 12/2013 ..... B66C 13/46

* cited by examiner

REEL HOIST INTERLOCK SYSTEM

CROSS-REFERENCE TO RELATED APPLICATION

This non-provisional application is based upon U.S. Provisional Patent Application No. 61/918,132, filed Dec. 19, 2013, which is incorporated herein by reference in its entirety.

BACKGROUND

The present invention relates generally to overhead cranes, and more specifically, to a reel hoist interlock system for use with an overhead crane.

Overhead cranes, such as bridge cranes and gantry cranes, are currently used in a large number of industrial applications to move materials during manufacturing processes. In general, overhead cranes are used to lift objects using hoists which move horizontally on a rail, or pair of rails. Overhead cranes are particularly suited to lifting very heavy objects where the crane straddles the object to be lifted and moved.

Currently, overhead cranes are used to move large objects, such as large rolls of paper, from one location to another during a manufacturing process. As shown in FIG. 1, a typical overhead crane 100 includes a gantry 102, or supporting beam, which travels on a pair of rails 104. The overhead crane 100 also includes a pair of hoists 106, such as reel hoists, that are disposed on the gantry 102. Each hoist 106 is connected to a hook 108 configured to engage the object 110 to be moved. Typically, the overhead crane 100 is operated by a remote 112 that controls the movement of the gantry 102 along the rails 104 as well as the operation of the hoists 106 to raise and lower the hooks 108. In most cases, the remote 112 is physically connected to the overhead crane 100 and the operator of the remote 112 is located near the object 110 to be moved.

In many cases, due to the size of the object 110 to be moved, the operator of the overhead crane 100 may only be able to see one of the two hooks 108 while operating the remote 112. Accordingly, the operator is not able to easily verify that both hooks 108 are properly secured to the object 110 to be lifted without walking around the object 110 and inspecting both hooks 108.

If only one hook 108 of the overhead crane is secured to the object 110 prior to lifting the object 110, the object 110 may be improperly lifted and may tip over, as shown in FIG. 2A. In addition, if one or more of the hooks 108 are not properly secured to the object 110 prior to lifting the object 110, as shown in FIG. 2B, the object 110 may be unstable and may fall while being moved.

SUMMARY

Embodiments include a reel hoist interlock system for an overhead crane having one or more sensors disposed on a hook of the overhead crane. The one or more sensors provide a signal indicative of whether the hook is secured to an object to be lifted by the overhead crane. The reel hoist interlock system also includes one or more transmitters in communication with the one or more sensors. The one or more transmitters receive and transmit the signal provided by the one or more sensors. The reel hoist interlock system further includes a controller configured to operate the overhead crane based on an input signal received from a remote and based on the signals received from the one or more transmitters, and one or more indicators operated by the controller based on the signals received from at least one of the one or more transmitters and the remote.

Embodiments also include an overhead crane having one or more supporting rails, a gantry moveably disposed on the one or more supporting rails, and one or more reel hoists disposed on the gantry, wherein each of the one or more reel hoists are configured to raise and lower a cable to lift an object. The overhead crane also includes one or more hooks disposed on the cable, wherein the one or more hooks are configured to secure the cable to the object, a sensor disposed on each of the one or more hooks, wherein the sensor provides a signal indicative of whether the hook is secured to the object, and a transmitter in communication with the sensor, wherein the transmitter receives and transmits the signal provided by sensor. The overhead crane further includes a controller configured to operate the overhead crane based on an input signal received from a remote and based on the signal received from the transmitter, and one or more indicators operated by the controller based on at least one of the signals received by the one or more transmitters and the input signal.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
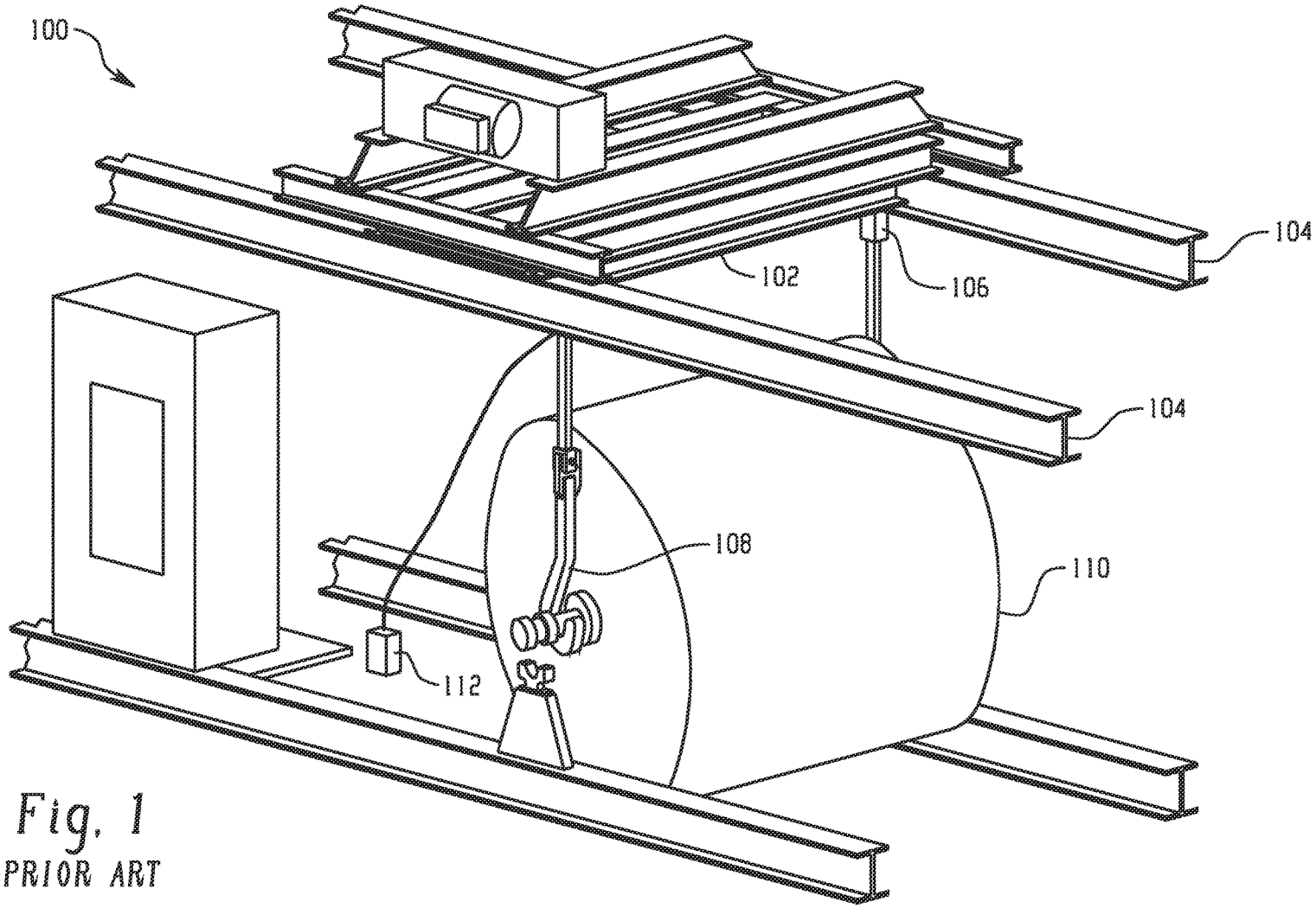
Fig. 1 PRIOR ART
FIG. 1 is a perspective view of an overhead crane as known in the prior art.
Figure 2B:
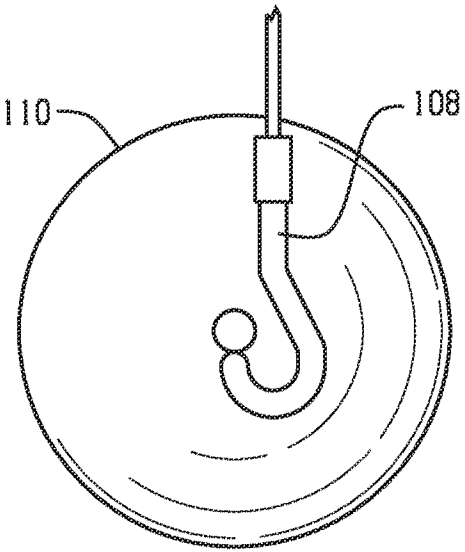
FIG. 2B is a side view of an overhead crane showing an improperly secured hook of an overhead crane of FIG. 1.
Figure 2A:
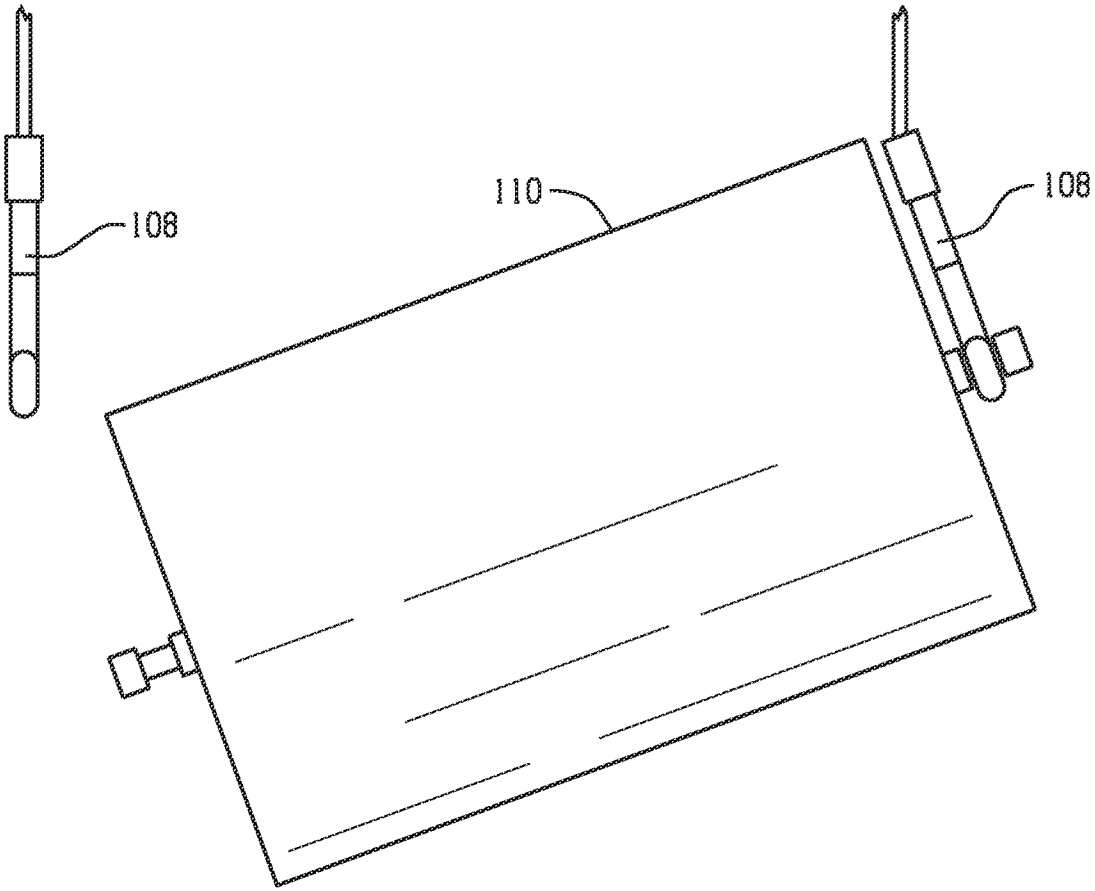
FIG. 2A is a side view of an overhead crane showing a lift by an overhead crane of FIG. 1 with a single hook engaged.
Figure 3:
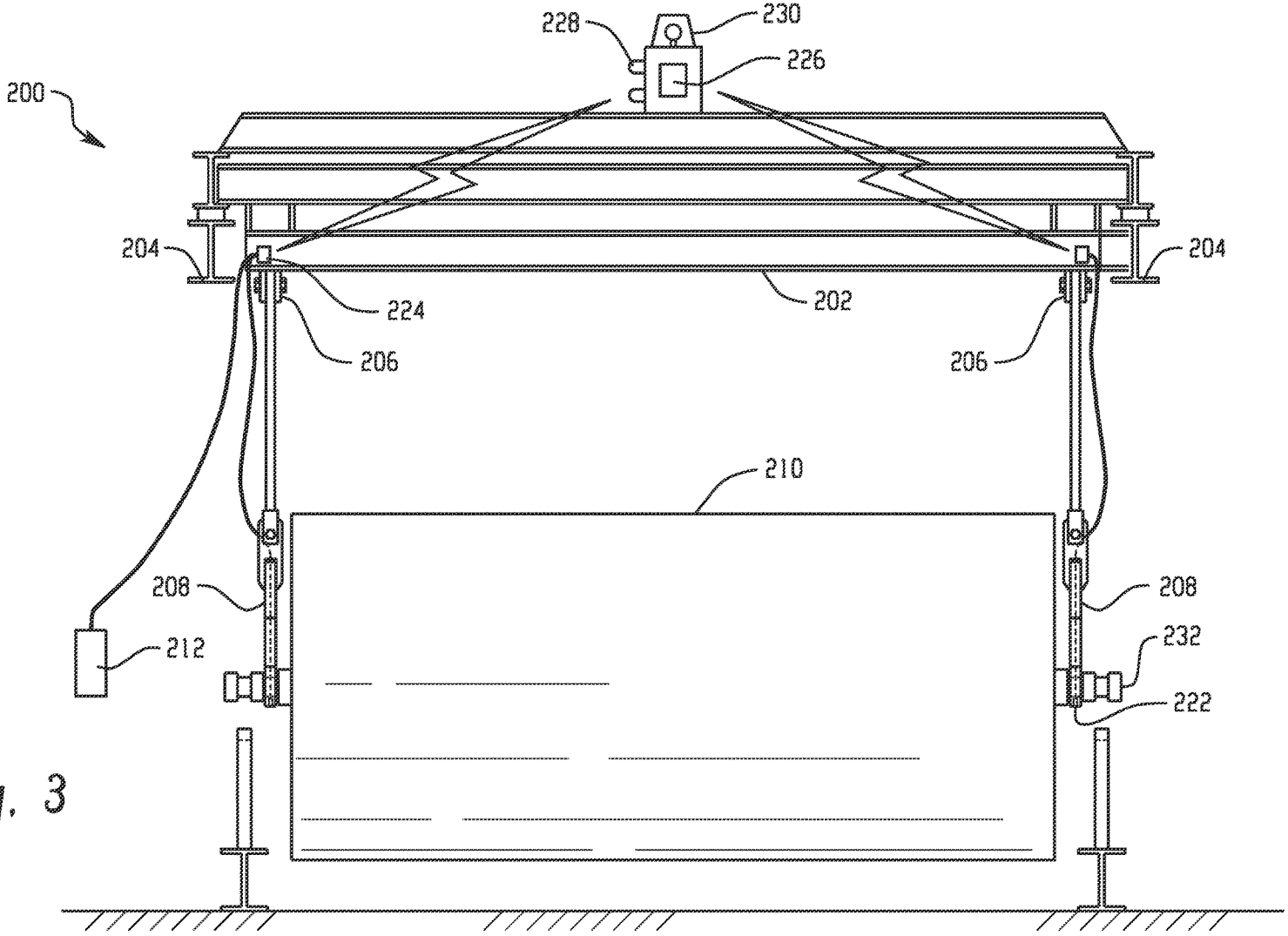
FIG. 3 is a perspective view of overhead crane having a reel hoist interlock system in accordance with an exemplary embodiment.

Referring now to FIG. 3, an overhead crane 200 having a reel hoist interlock system in accordance with an exemplary embodiment is shown. The overhead crane 200 includes a gantry 202, or supporting beam, which travels on a pair of rails 204. The overhead crane 200 also includes a pair of reel hoists 206 which are disposed on the gantry 202. Each reel hoist 206 is connected to a hook 208 configured to engage an object 210 to be moved. In exemplary embodiments, the overhead crane 200 is operated by a remote 212 that controls the movement of the gantry 202 along the rails 204 and the operation of the reel hoists 206 to raise and lower the hooks 208. In exemplary embodiments, the reel hoist interlock system is configured to ensure that the hooks 208 are properly secured to the object 210 before the crane 200 is operated.

In exemplary embodiments, the reel hoist interlock system includes sensors 222 that are disposed in each hook 208. The sensors 222 are designed to detect when the hook 208 is properly secured to an object 210 to be lifted. In exemplary embodiments, the sensors 222 may be proximity sensors that are disposed on a bottom surface of an inner portion of the hooks 208. For example, the object 210 may include a metal support member 232 that is configured to be grabbed by the hooks 208 and the sensors 222 may be inductive sensors that are configured to detect the presence of the object 210.

Figure 4C:
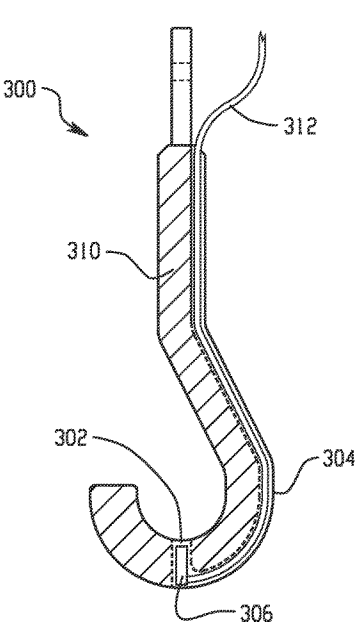
FIGS. 4A, 4B and 4C are respectively side, rear and cross-sectional views of a hook for use in the overhead crane having a reel hoist interlock system of FIG. 3 in accordance with an exemplary embodiment.
Figure 4B:
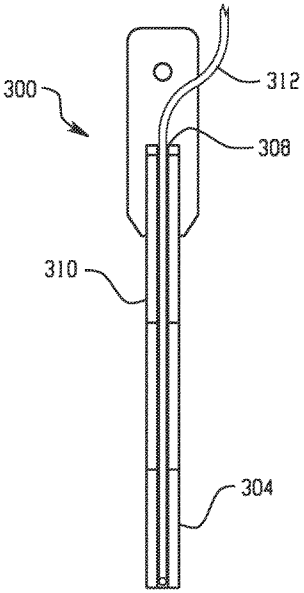
Figure 4A:
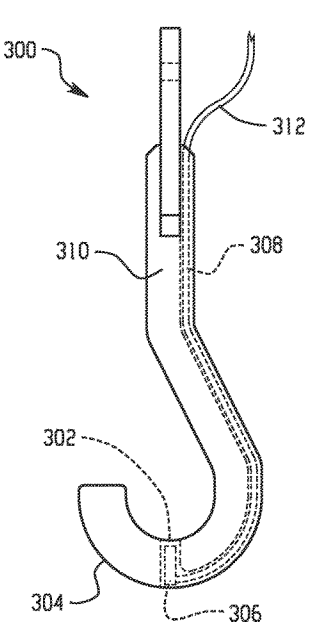

Referring now to FIGS. 4A, 4B and 4C, a hook 300 for use with the reel hoist interlock system in accordance with an embodiment is shown. As illustrated the hook 300 includes an opening 302 disposed on a bottom portion 304 of the hook 300, which extends through the hook 300. In exemplary embodiments, the size of the opening 302 is selected to tightly fit a sensor 306. In one embodiment, the sensor 306 is disposed in the opening 302 such that the top portion of the sensor 306 is recessed from the inner surface of the hook 300. In another embodiment, the sensor 306 is disposed in the opening 302 such that the top portion of the sensor 306 flush with the inner surface of the hook 300.

In one embodiment, the hook 300 also includes a channel 308 which extends from the opening 302 around an outer surface of the hook 300 to a top portion 310 of the hook 300. In exemplary embodiments, the channel 308 is configured to receive a cable 312 that is connected to the sensor 306. In exemplary embodiments, the channel 308 is configured to be sufficiently deep such that the cable 312 does not protrude from the outer surface of the hook 300.

Continuing with reference to FIG. 3, the sensors 222 are in communication with transmitters 224. In one embodiment, the transmitters 224 are connected to the sensors 222 via a cable and the transmitters 224 may be disposed on the gantry 202. In another embodiment, the sensors 222 may be directly connected to or may include transmitters 224. In exemplary embodiments, the sensors 222 are configured to provide a signal to the transmitters 224 which indicates if the sensors 222 detect that the object 210 is secured to the hook 208. In turn, the transmitters 224 transmit the signal provided by the sensors 222 to a controller 226.

In exemplary embodiments, the overhead crane 200 may include a spreader bar (not shown) disposed below the gantry 202. In one embodiment, the hooks 208 and cable are attached to this spreader bar, which can be rotated under power. In exemplary embodiments, the spreader bar rotates relative to the gantry 202 and precludes the use of wires between the sensor 222 and the controller 226. Accordingly, the wireless transmitter 224 is used to transmit the signal form the sensor 222 to the controller 226 independent of the spreader bar rotation.

In exemplary embodiments, the reel hoist interlock system includes a controller 226 which receives the signals provided by the transmitters 224. The controller 226 is in communication with the control system (not shown) for the crane 200 and is configured to prevent the crane 200 from being operated unless both hooks 208 are properly secured to the object 210. In one embodiment, the controller 226 may be separate from the control system for the crane 200 and in another embodiment the controller 226 may be integrated into the control system for the crane 200.

In one embodiment, the reel hoist interlock system includes indicator lights 228. The indicator lights 228 may be disposed on the gantry 202, the remote 212, or other suitable position on the crane 200. Each of the indicator lights 228 is configured to provide a visual indicator of the status of the hooks 208. For example, each indicator light 228 may be designed to be in an off position when the sensor 222 for a hook 208 does not detect that the hook 208 is engaged with the object 210 and to be in an on position when the sensor 222 for a hook 208 detects that the hook 208 is engaged with the object 210. Accordingly, an operator of the crane 200 may be able to quickly and easily determine that both hooks 208 are properly secured to the object 210 prior to attempting to operate the crane 200. In exemplary embodiments, the indicator lights 228 may also serve as a maintenance diagnostic tool. For example, since it is difficult to see the position of the hook sensor with respect to the shaft as the shaft obstructs the view when it is in position in the hook, the indicator lights 228 can be used by maintenance personnel while adjusting the position of the sensor 222 in the hook 208. If the indicator light 228 is off, the maintenance technician knows the sensor 222 is not in proper position and must be adjusted up (closer to the shaft) until the indicator light 228 comes on, at which point the sensor 222 is properly positioned.

In exemplary embodiments, the controller 226 may prevent the hoists 206 and gantry 202 from moving when the sensors 222 do not detect that the object 210 is secured to the hooks 208. For example, upon receiving a signal to activate the hoists 206 to lift the object 210 or a signal to move the gantry 202, the controller 226 may verify that the sensors 222 indicate that the hooks 208 are secured to the object 210 before activating the hoists 206 or moving the gantry 202. In exemplary embodiments, the controller 226 may be configured to allow the hoists 206 and gantry 202 to move for a short amount of time or distance, for example a few centimeters or a fraction of a second, while determining if the hooks 208 are secured to the object 210. This small movement will allow for the hooks 208 to engage the object 210 and allow for any delay in the signal from the sensors 222.

In exemplary embodiments, the reel hoist interlock system may be configured to operate in an override setting that allows the crane 200 to move even though the sensors 222 do not indicate that the hooks 208 are secured to the object 210. In exemplary embodiments, the crane 200 may be operated in the override setting when there is a malfunction of the reel hoist interlock system or when the crane 200 is being moved without an object 210 attached to the crane 200. In exemplary embodiments, the reel hoist interlock system includes an override indictor 230 which may be disposed on the gantry 202, or another suitable location, which is configured to operate when the crane 200 is being operated in the override setting. In one embodiment, the override indicator 230 may be a light such as a strobe light, a flashing light or an auditory indicator designed to warn people near the crane 200 that the crane 200 is being operated in the override setting.

Figure 5:
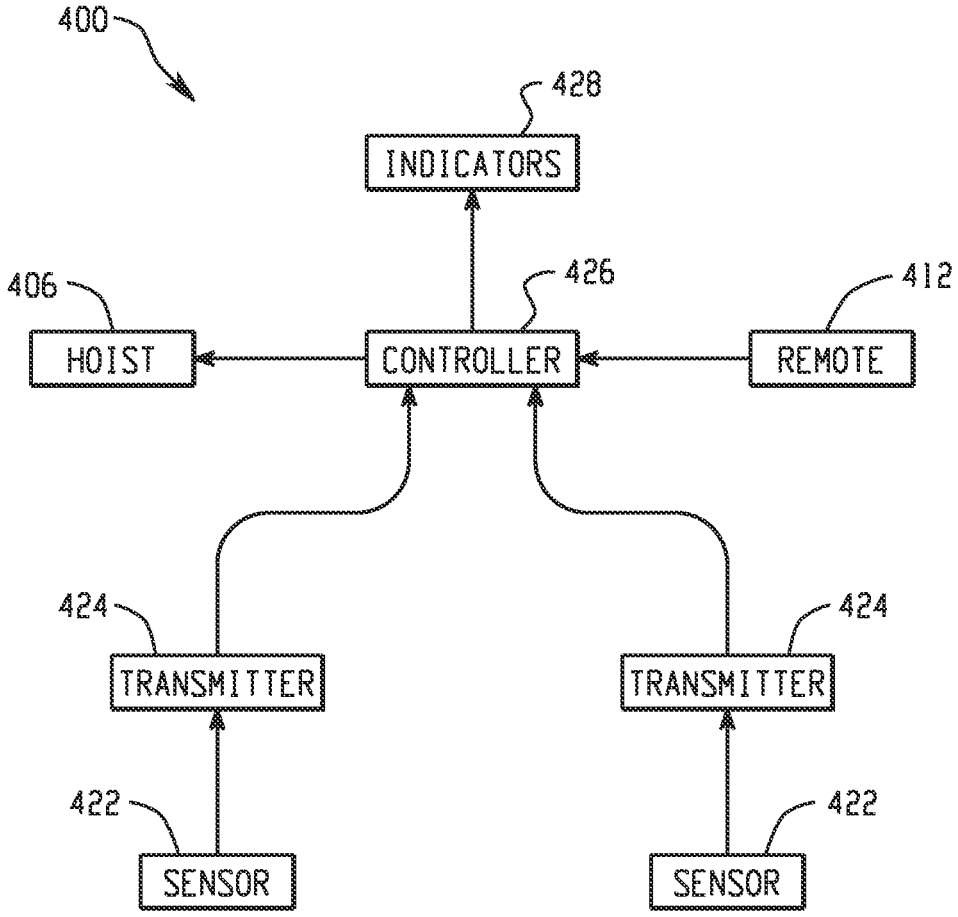
FIG. 5 is a block diagram of a reel hoist interlock system in accordance with an exemplary embodiment.

Referring now to FIG. 5, a block diagram of a reel hoist interlock system 400 in accordance with an exemplary embodiment is shown. The reel hoist interlock system 400 includes sensors 422 that are each configured to communicate with transmitters 424. The reel hoist interlock system 400 also includes a controller 426 that is configured to communicate with the transmitters 424. The controller 426 is configured to operate the hoists 406 based on input signals received from a remote 412 and from the transmitters 424. In addition, the controller 426 is configured to operate one or more indicators 428 based on input signals received from a remote 412 and from the transmitters 424.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. An overhead crane having a reel hoist safety interlock system, the system comprising:

at least two sensors, each of the sensors being disposed in separate hooks of the overhead crane, wherein the at least two sensors provide a signal indicative of whether the hooks are secured to an object to be lifted by the overhead crane;

at least one transmitter in communication with the at least two sensors, wherein the at least one transmitter receive and transmit the signal provided by the at least two sensors;

a controller configured to operate the overhead crane based on an input signal received from a remote and based on the signals received from the at least one transmitter; and at least two indicator lights operated by the controller based the signals received from at least one of the at least one transmitter and the remote, wherein each of the at least two sensors are disposed in an opening located on a bottom portion of the hook and wherein the opening extends through the bottom portion the hook.

2. The reel hoist safety interlock system of claim 1, wherein the at least two sensors are proximity sensors.

3. The reel hoist safety interlock system of claim 1, wherein the at least two sensors are disposed on a bottom surface of an inner portion of the hook.

4. The reel hoist safety interlock system of claim 1, wherein at least one of the at least two indicator lights are configured to provide an indication that the hook is secured to the object.

5. The reel hoist safety interlock system of claim 1, wherein the input signal received from the remote is an override signal which causes the controller to disregard the signals received from the at least one transmitter during operation of the overhead crane.

6. The reel hoist safety interlock system of claim 5, wherein one of the at least two indicator lights is configured to provide an indication that the overhead crane is being operated in an override mode.

7. An overhead crane comprising:

one or more supporting rails;

a gantry moveably disposed on the one or more supporting rails;

at least two reel hoists disposed on the gantry, wherein each of the one or more reel hoists are configured to raise and lower a cable to lift an object;

at least two hooks disposed on the cable, wherein the one or more hooks are configured to secure the cable to the object;

a sensor disposed in each of the at least two hooks, wherein the sensor provides a signal indicative of whether the hook is secured to the object, wherein the sensor is disposed in an opening located on a bottom portion of the hook and wherein the opening extends through the bottom portion the hook;

a transmitter in communication with the sensor, wherein the transmitter receives and transmits the signal provided by sensor;

a controller configured to operate the overhead crane based on an input signal received from a remote and based on the signal received from the transmitter; and at least two indicator lights operated by the controller based on at least one of the signals received by the at least one transmitters and the input signal.

8. The overhead crane of claim 7, wherein the sensor is a proximity sensor.

9. The overhead crane of claim 7, wherein at least one of the at least two indicator lights are configured to provide an indication that the hook is secured to the object.

10. The overhead crane of claim 7, wherein the input signal received from the remote is an override signal which causes the controller to disregard the signals received from the at least one transmitter during operation of the overhead crane.

11. The overhead crane of claim 10, wherein one of the at least two indicator lights is configured to provide an indication that the overhead crane is being operated in an override mode.

* * * * *